United States Patent [19]

Maza et al.

[11] 4,253,260

[45] Mar. 3, 1981

[54] SELF-STANDING FLOOR SIGN

[75] Inventors: Dale T. Maza, Stephenson; Glen E. Tomblin, Winchester; Harold Ruckman, Stephenson, all of Va.

[73] Assignee: Rubbermaid Commercial Products Inc., Winchester, Va.

[21] Appl. No.: 85,859

[22] Filed: Oct. 18, 1979

[51] Int. Cl.[3] ..... G09F 15/00

[52] U.S. Cl. ..... 40/610; 116/63 P; 16/171

[58] Field of Search ..... 40/584, 606, 607, 610; 116/63 P; 248/166

[56] References Cited

U.S. PATENT DOCUMENTS

| | | | |
|---|---|---|---|
| 1,115,021 | 10/1914 | Pummiii | 40/610 |
| 1,284,624 | 11/1918 | Ehrenberg | 40/610 |
| 3,231,994 | 2/1966 | Cyrus | 116/63 P |
| 3,846,935 | 11/1974 | Wagner | 40/606 |

FOREIGN PATENT DOCUMENTS

| | | | |
|---|---|---|---|
| 746454 | 5/1933 | France | 40/606 |
| 272657 | 6/1927 | United Kingdom | 40/606 |

*Primary Examiner*—Gene Mancene
*Assistant Examiner*—Wenceslao J. Contreras
*Attorney, Agent, or Firm*—Hamilton, Renner & Kenner

[57] ABSTRACT

A self-standing floor sign comprising two panels (15 and 16) hinged together at their upper ends, one panel (16) having a tubular hinge portion (24) provided with a slot (27) (28), the other panel having a core (31) (32) rotatable in said hinge portion (24), said core having a laterally directed U-shaped notch (31') (32') adapted to allow said core to hook into and pass laterally through said slot (27) (28) into said hinge portion (24) by simultaneously rotating and pressing radially inward on said core (31) (32) to snap it past the upper edge of said slot (27) (28).

8 Claims, 12 Drawing Figures

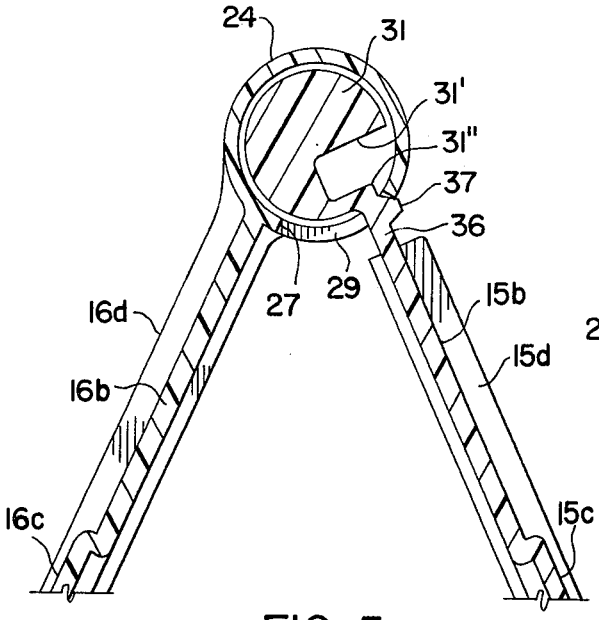
FIG. 5
FIG. 7
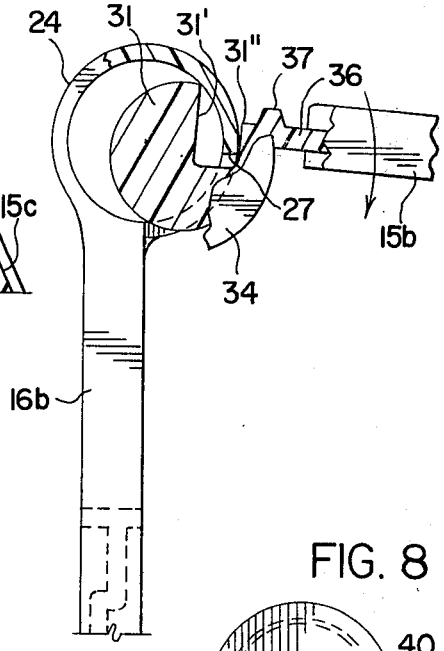
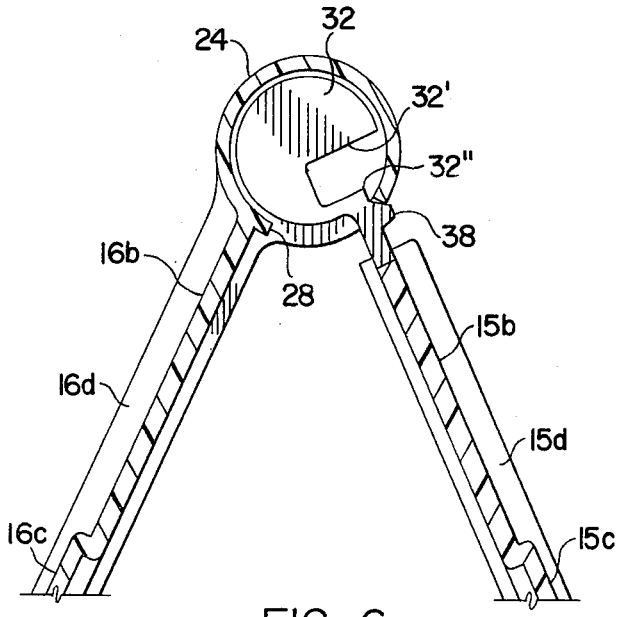
FIG. 6
FIG. 8
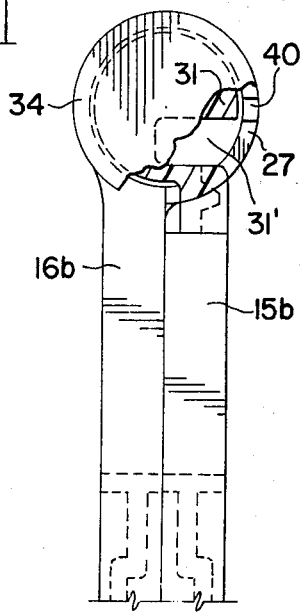

SELF-STANDING FLOOR SIGN

BACKGROUND ART

Prior self-standing floor signs of which we have knowledge comprise wire frames hinged together at the top with metal or plastic panels supported on the frames. During handling the frames become bent and distorted so that they are unstable and do not stand firmly on the supporting floor. Moreover, as the frames are folded and knocked about they create a substantial amount of noise. Further, the frames are subject to corrosion as the are used on wet floors in the presence of mopping and scrubbing operations.

DISCLOSURE OF INVENTION

The present improved self-standing sign is constructed entirely of plastic material which is quieter and more stable than prior constructions comprising wire frames.

It is an object of the present invention to provide an improved self-standing floor sign comprising two panel members each molded of plastic and having integral interfitting hinge portions at their upper ends for selectively folding and swinging the panel members apart.

Another object is to provide an improved construction in which the hinge portions are adapted to snap together into interlocking rotatable relation.

A further object is to provide an improved hinge construction which allows the panels to collapse or fold and limits their spreading-apart movement.

These and other related objects are accomplished by the improvements comprising the present invention, a preferred embodiment of which is disclosed and described herein as exemplifying the best known mode of carrying out the invention. Various modifications and changes in details of construction are comprehended within the scope of the appended claims.

BRIEF DESCRIPTION OF DRAWINGS

FIG. 5 is a fragmentary sectional view on line 5—5 of FIG. 4.

FIG. 6 is a fragmentary sectional view on line 6—6 of FIG. 4.

FIG. 7 is a fragmentary side elevation partly broken away, showing how the two hinge portions are snapped into interlocking relation.

FIG. 8 is a fragmentary side elevation, partly broken away, showing the hinge portions interlocked and folded together.

PREFERRED EMBODIMENT FOR CARRYING OUT THE INVENTION

Figure 1:
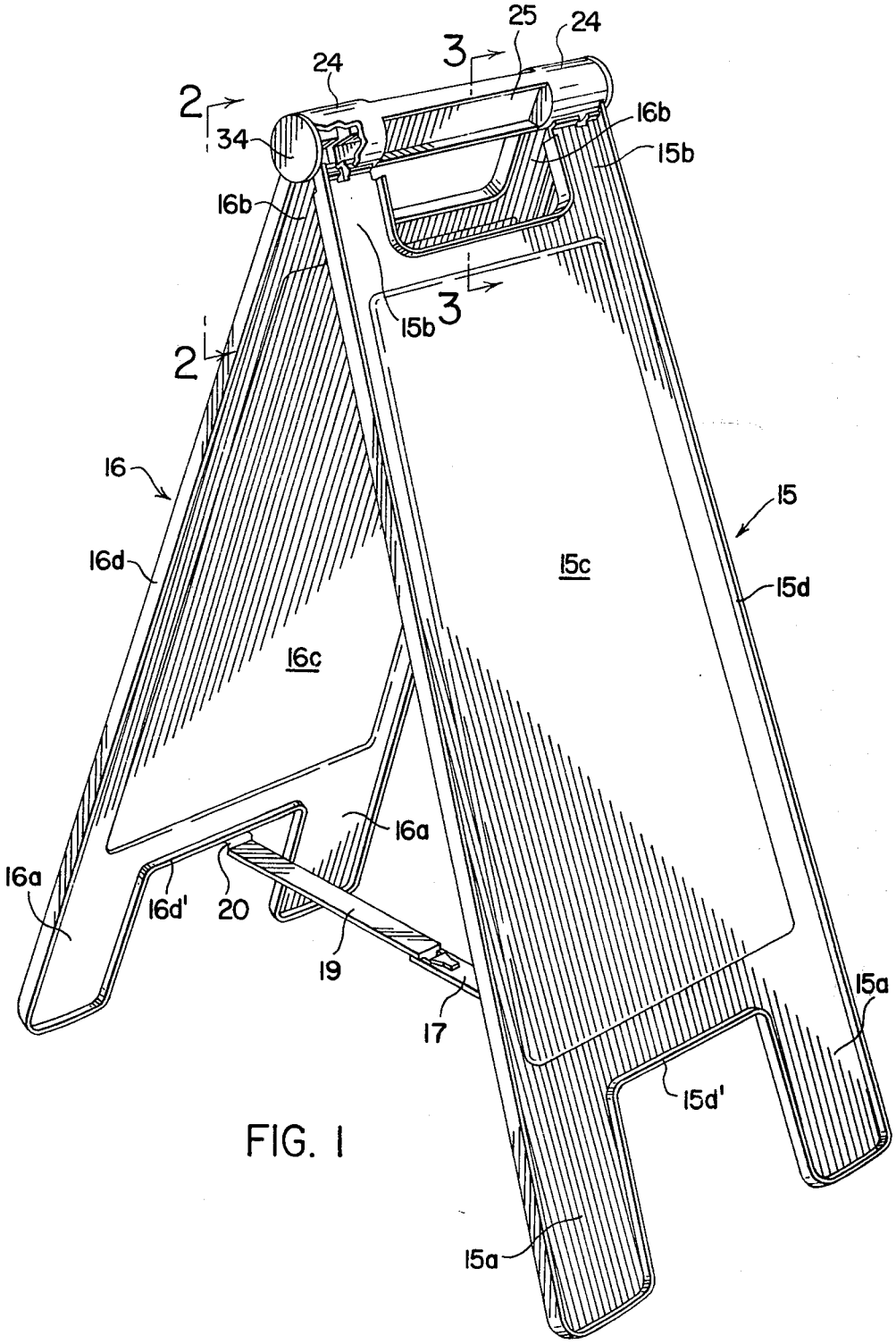
FIG. 1 is a front perspective view of the improved self-standing floor sign in unfolded or spread-apart position.
Figure 2:
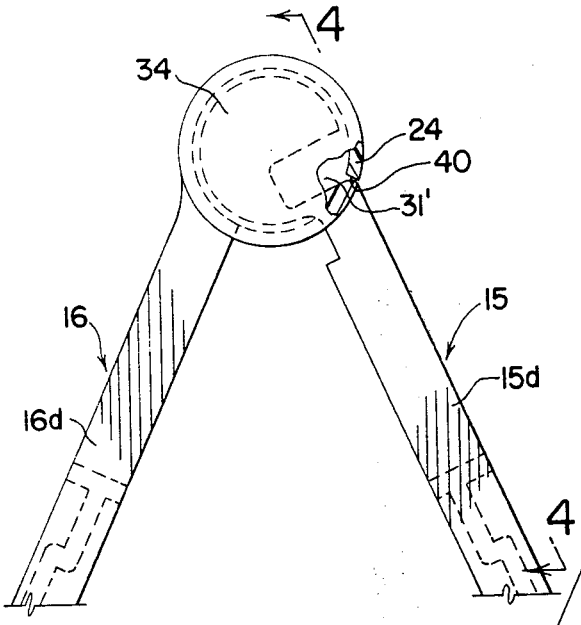
FIG. 2 is an enlarged fragmentary side elevation, partly broken away, on line 2—2 of FIG. 1.
Figure 3:
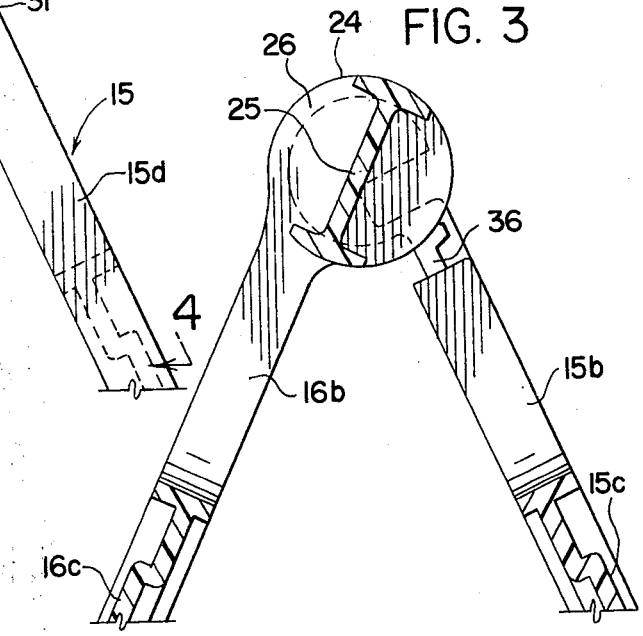
FIG. 3 is an enlarged fragmentary sectional view on line 3—3 of FIG. 1.

Referring first to FIG. 1, the improved sign comprises a front panel member indicated generally at 15 and a rear panel member indicated generally at 16. The panel members 15 and 16 each have laterally spaced lower leg portions **15*a* and 16*a* and laterally spaced upper leg portions 15*b* and 16*b*, respectively. Between the lower and upper leg portions the panel members 15 and 16 are preferably provided with flat embossed panels 15*c* and 16*c*, respectively, on which suitable lettering or indicia may be applied. Preferably, continuous ribs 15*d* and 16*d* extend around the outer peripheries of the panel members 15 and 16, including the leg portions 15*a*, 15*b*, 16*a* and 16*b***.

Figure 11:
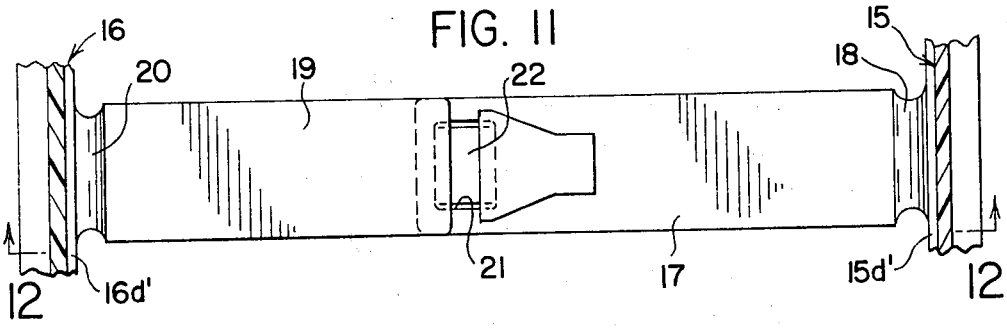
FIG. 11 is a top view of the straps on the panel portions in extended interengaging position to hold the lower ends of the panels in spread-apart position.
Figure 12:
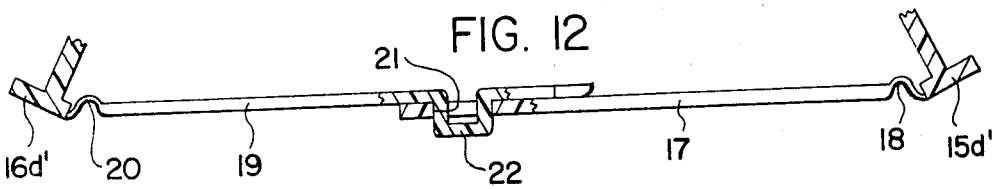
FIG. 12 is a fragmentary sectional view on line 12—12 of FIG. 11.

The panel members 15 and 16 are hinged together at the tops of legs **15*b* and 16*b*, and adapted to be spread apart, as shown in FIG. 1, to a self-standing position, or folded or collapsed one upon the other as shown in FIG. 8. As best shown in FIGS. 11 and 12, member 15 has a plastic strap 17 connected by a thin flexible hinge portion 18 to the inner edge of its peripheral flange 15*d*' extending between legs 15*a*. Similarly, member 16 has a plastic strap 19 connected by a thin flexible hinge portion 20 to the inner edge of its peripheral flange 16*d*' extending between legs 16*a***.

The strap 17 has at its inner end a rectangular slot 21, and the strap 19 has near its inner end a U-shaped portion 22 adapted to engage tightly in the slot 21, when the straps 17 and 19 are extended inwardly toward each other, thereby restraining the lower ends of panels 15 and 16 from spreading further apart. When the panels are folded together as in FIG. 8, the straps 17 and 19 fold alongside the inner surfaces of the panels **15*a* and 16*a***, respectively.

Figure 4:
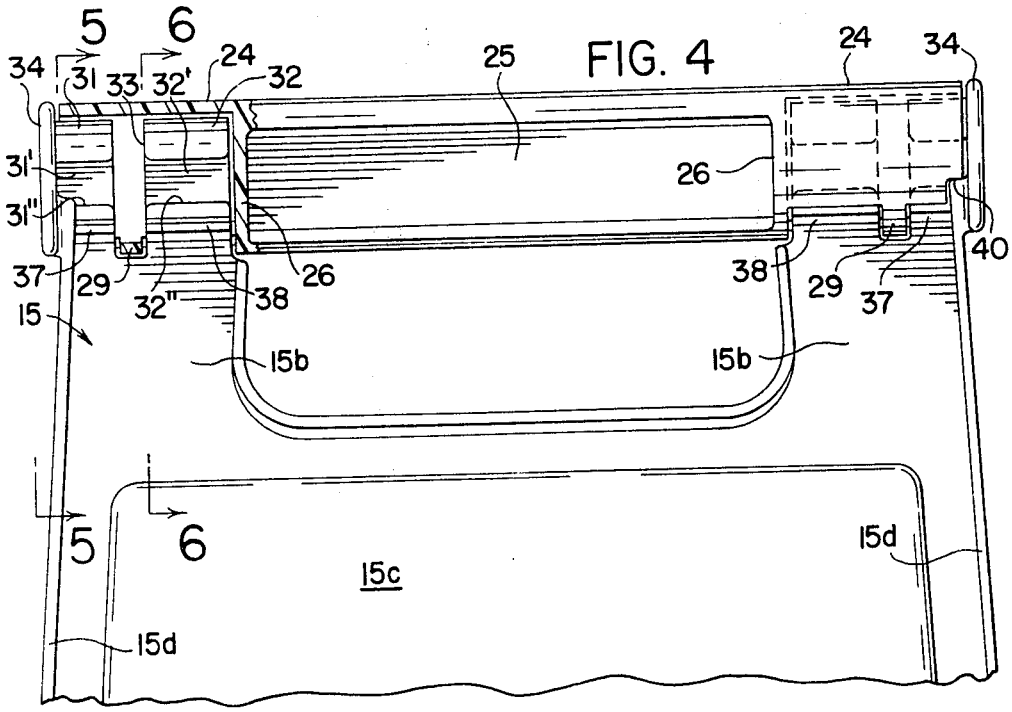
FIG. 4 is an enlarged fragmentary front elevation of the upper hinge portion, partly broken away and in section, as on line 4—4 of FIG. 2.

As shown in FIGS. 1 and 4, tubular hinge portions 24 are formed at the upper ends of legs **16*b* and are integral therewith. The portions 24 are connected by a crossbar 25 preferably of I-shaped cross section having circular walls 26 at its ends forming the inner ends of the hinge portions 24. As seen in FIGS. 4–6 and 9, each hinge portion 24 has in its lower rear quadrant longitudinally aligned outer and inner slots 27 and 28 divided or separated by a narrow arcuate wall 29, slot 27 extending laterally inward from the outer end of the tube to the wall 29, and slot 28 extending from wall 29 to the end wall 26**.

Figure 9:
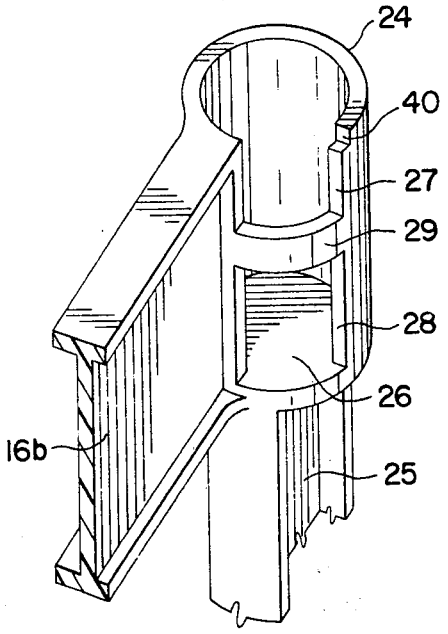
FIGS. 9 and 10 are fragmentary rear perspective views of the two hinge portions before assembly, the hinge portion in FIG. 10 being inverted in relation to the hinge portion in FIG. 9 in order to show its inner construction.
Figure 10:
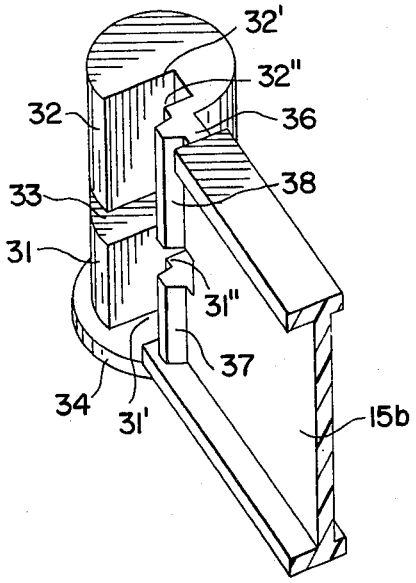

As shown in FIGS. 4–6 and 10, substantially cylindrical longitudinally aligned hinge core portions 31 and 32 are formed integral with the upper ends of legs **15*b* of front panel member 15, and the core portions are divided by a transverse slot 33. The cores are adapted to fit rotatably in the tubular hinge portions 24. The core portions 31 have outer circular caps 34 adapted to abut the outer edges of tubular portions 24 when the cores are inserted therein. Referring to FIGS. 9 and 10, when the cores 31 and 32 are inverted, core portion 32 is inserted radially through slot 28 and core portion 31 through slot 27, with slot 33 receiving arcuate wall 29 to prevent axial movement of the cores in the tubes 24**.

In order to accomplish radial insertion of the cores 31 and 32 through slots 27 and 28, respectively, so that the cores are rotatable in but not removable from the tubular hinge portions, the cores are provided with laterally directed U-shaped notches 31' and 32', respectively, extending axially through the cores. At the lower edges of the notches the cores are connected to the upper edges of legs **15*b* by necks 36 and the necks have aligned transverse ribs 37 and 38 formed thereon. The slots 33 extend into the necks 36 and form separate ribs 37 and 38. The ribs are spaced from the lower edges of notches 31' and 32' so as to form corners 31'' and 32''** at the respective edges.

Referring to FIG. 7, the cores 31 and 32 are inserted into slots 27 and 28 by first hooking the notches 31' and 32' laterally through the slots and then rotating the legs **15*b* downwardly clockwise, at the same time pressing radially inward on the cores to distort the tubes 24 sufficiently to allow the corners 31'' and 32'' to snap past the edges of the slots 27 and 28. The cores are now permanently locked in the tubes 24 because the sharp corners 31'' and 32'' can not be snapped out past the upper edges of slots 27 and 28. The counterclockwise rotation of the cores is limited by the engagement of ribs 37 and 38 with the upper edges of slots 27 and 28 at the spread-apart position of the panel members 15 and 16 shown in FIGS. 1–6. As shown in FIGS. 4, 8 and 9 notches 40 are formed at the outer ends of the upper edges of slots 27 to receive the upper ends of ribs 15*d*** in the spread-apart position.

It should be apparent that the improved self-standing all plastic floor sign provides a stable construction which is relatively quiet during folding and handling, with integral interfitting hinge portions adapted to be assembled by snapping them together into interlocked rotatable relation.

We claim:

1. A self-standing all plastic floor sign comprising two panels hinged together at their upper ends for selectively folding and spreading the lower ends of the panels apart, one panel having an integral tubular hinge portion at its upper end provided with a longitudinal slot in its lower portion, the other panel having an integral core rotatable in said tubular hinge portion, said core having a laterally directed U-shaped notch adapted to allow the core to hook into and pass laterally through said slot into said tubular hinge portion by simultaneously rotating and pressing radially inward on the core to snap it past the upper edge of said slot.

2. A self-standing all plastic floor sign as described in claim 1, wherein the lower edge of said U-shaped notch is provided with a sharp corner adapted to snap past the upper edge of said longitudinal slot and to prevent subsequent withdrawal of the core through the slot.

3. A self-standing all plastic floor sign as described in claim 2, wherein a neck on said other panel connects it to said core, and a transverse rib on said neck limits rotation of the core by engagement with the upper edge of said slot.

4. A self-standing all plastic floor sign as described in claim 1, wherein a cap on the outer end of said core is adapted to abut the outer end of said tubular hinge portion when the core is inserted therein.

5. A self-standing all plastic floor sign as described in claim 1, wherein a transverse slot divides said core into outer and inner portions and an arcuate rib on said tubular hinge portion received in said transverse slot divides said longitudinal slot into outer and inner portions.

6. A self-standing all plastic floor sign as described in claim 5, wherein the lower edge of said U-shaped notch in said core portions is provided with a sharp corner adapted to snap past the upper edge of said longitudinal slot portions and to prevent subsequent withdrawal of the core through the slot.

7. A self-standing all plastic floor sign as described in claim 6, wherein a neck on said other panel connects it to said core portions, and a transverse rib on said neck limits rotation of said core portions by engagement with the upper edge of said longitudinal slot.

8. A self-standing all plastic floor sign as described in claim 7, wherein said transverse slot dividing said core portions extends into said neck and divides said transverse rib into outer and inner portions.

* * * * *